US010683568B2

(12) United States Patent
Kato et al.

(10) Patent No.: US 10,683,568 B2
(45) Date of Patent: Jun. 16, 2020

(54) HEAT-RESISTANT SINTERED MATERIAL HAVING EXCELLENT OXIDATION RESISTANCE, HIGH-TEMPERATURE WEAR RESISTANCE AND SALT DAMAGE RESISTANCE, AND METHOD FOR PRODUCING SAME

(71) Applicant: Diamet Corporation, Niigata-shi (JP)

(72) Inventors: Kenichi Kato, Niigata (JP); Tatsuki Mizuno, Niigata (JP); Masahisa Miyahara, Niigata (JP)

(73) Assignee: Diamet Corporation, Niigata-shi (JP)

( * ) Notice: Subject to any disclaimer, the term of this patent is extended or adjusted under 35 U.S.C. 154(b) by 204 days.

(21) Appl. No.: 15/561,375

(22) PCT Filed: Mar. 25, 2016

(86) PCT No.: PCT/JP2016/059601
§ 371 (c)(1),
(2) Date: Sep. 25, 2017

(87) PCT Pub. No.: WO2016/158738
PCT Pub. Date: Oct. 6, 2016

(65) Prior Publication Data

US 2018/0080105 A1 Mar. 22, 2018

(30) Foreign Application Priority Data

Mar. 27, 2015 (JP) ..... 2015-066748

(51) Int. Cl.
*C22C 38/44* (2006.01)
*C22C 38/22* (2006.01)
(Continued)

(52) U.S. Cl.
CPC ..... *C22C 38/40* (2013.01); *B22F 1/0003* (2013.01); *B22F 3/16* (2013.01); *B22F 5/009* (2013.01);
(Continued)

(58) Field of Classification Search
None
See application file for complete search history.

(56) References Cited

U.S. PATENT DOCUMENTS 3,785,801 A * 1/1974 Benjamin ..... B22F 9/04 419/1
2004/0069094 A1 4/2004 Sato et al.
(Continued)

FOREIGN PATENT DOCUMENTS

EP 2339042 A1 6/2011
GB 749472 * 5/1956
(Continued)

OTHER PUBLICATIONS

Extended European Search Report dated Jan. 2, 2019 for the corresponding European Patent No. 16772619.9.
(Continued)

*Primary Examiner* — Humera N Sheikh
*Assistant Examiner* — Xiaobei Wang
(74) *Attorney, Agent, or Firm* — Leason Ellis LLP

(57) ABSTRACT

An object of this heat-resistant sintered material and a production method therefor is to obtain a heat-resistant sintered material having excellent oxidation resistance, high-temperature wear resistance and salt damage resistance. This heat-resistant sintered material has a composition containing, in mass % values, Cr: 25 to 50%, Ni: 2 to 25% and P: 0.2 to 1.2%, with the remainder being Fe and unavoidable impurities, and has a structure including an Fe—Cr matrix, and a hard phase composed of Cr—Fe alloy
(Continued)

particles dispersed within the Fe—Cr matrix, wherein the Cr content of the Fe—Cr matrix is from 24 to 41 mass %, the Cr content of the hard phase is from 30 to 61 mass %, and the effective porosity is 2% or less.

14 Claims, 3 Drawing Sheets

(51) Int. Cl.

| | |
|---|---|
| ***C22C 38/00*** | (2006.01) |
| ***C22C 33/02*** | (2006.01) |
| ***B22F 3/12*** | (2006.01) |
| ***B22F 1/00*** | (2006.01) |
| ***C22C 38/40*** | (2006.01) |
| ***C22C 38/18*** | (2006.01) |
| ***C22C 30/00*** | (2006.01) |
| ***C22C 1/04*** | (2006.01) |
| ***B22F 5/00*** | (2006.01) |
| ***C22C 27/06*** | (2006.01) |
| ***B22F 3/16*** | (2006.01) |

(52) U.S. Cl.

CPC ..... *C22C 1/045* (2013.01); *C22C 27/06* (2013.01); *C22C 30/00* (2013.01); *C22C 33/0214* (2013.01); *C22C 33/0285* (2013.01); *C22C 38/00* (2013.01); *C22C 38/002* (2013.01); *C22C 38/22* (2013.01); *C22C 38/44* (2013.01); *B22F 2301/35* (2013.01); *B22F 2998/10* (2013.01)

(56) References Cited

U.S. PATENT DOCUMENTS

| | | | | |
|---|---|---|---|---|
| 2005/0095163 | A1* | 5/2005 | Yoshihiro | C22C 32/0089 419/20 |
| 2006/0159376 | A1 | 7/2006 | Takayama et al. | |
| 2009/0269235 | A1* | 10/2009 | Fukae | B22F 3/12 419/11 |
| 2013/0058825 | A1* | 3/2013 | Fukae | C22C 33/0207 419/11 |
| 2014/0248174 | A1* | 9/2014 | Fukae | C22C 38/42 419/11 |

FOREIGN PATENT DOCUMENTS

| | | | |
|---|---|---|---|
| GB | 1504547 | * | 3/1978 |
| JP | S56-156702 | * | 12/1981 |
| JP | 03-072052 | A | 3/1991 |
| JP | 05-077025 | A | 3/1993 |
| JP | 2001-303233 | A | 10/2001 |
| JP | 2013-057094 | A | 3/2013 |
| JP | 2014-169468 | A | 9/2014 |
| WO | WO-2005/012585 | A | 2/2005 |

OTHER PUBLICATIONS

International Search Report dated Jun. 21, 2016 for the corresponding PCT Application No. PCT/JP2016/059601.

* cited by examiner

HEAT-RESISTANT SINTERED MATERIAL HAVING EXCELLENT OXIDATION RESISTANCE, HIGH-TEMPERATURE WEAR RESISTANCE AND SALT DAMAGE RESISTANCE, AND METHOD FOR PRODUCING SAME

CROSS-REFERENCE TO RELATED PATENT APPLICATIONS

This application is a U.S. National Phase Application under 35 U.S.C. § 371 of International Patent Application No. PCT/JP2016/059601 filed on Mar. 25, 2016 and claims the benefit of Japanese Patent Application No. 2015-066748 filed on Mar. 27, 2015, all of which are incorporated herein by reference in their entirety. The International Application was published in Japanese on Oct. 6, 2016 as International Publication No. WO/2016/158738 under PCT Article 21(2).

FIELD OF THE INVENTION

The present invention relates to a heat-resistant sintered material having excellent oxidation resistance, high-temperature wear resistance and salt damage resistance, and a method for producing the same.

BACKGROUND OF THE INVENTION

Turbochargers which utilize the energy of the exhaust gas from an internal combustion engine to generate high-speed rotation of a turbine, using that rotational force to drive a centrifugal compressor, and then feeding the resulting compressed air into the engine to enhance the thermal efficiency as an internal combustion engine are already known.

A turbocharger fitted to an internal combustion engine is provided with a nozzle mechanism or valve mechanism that diverts a portion of the exhaust gas and adjusts the inflow into the turbine.

The mechanism components such as bearings and bushes built into the turbocharger are continuously exposed to the high-temperature corrosive exhaust gas discharged from the engine, and are also moveable components that require excellent sliding characteristics.

Conventionally, heat-resistant components of wrought materials or sintered materials formed from high-Cr steel have been used for these types of sliding components exposed to high-temperature corrosive exhaust gases.

One example of a conventionally known sintered alloy for use in heat-resistant components is a sintered alloy having an overall composition containing, in mass % values, Cr: 11.75 to 39.98%, Ni: 5.58 to 24.98%, Si: 0.16 to 2.54%, P: 0.1 to 1.5% and C: 0.58 to 3.62%, with the remainder being Fe and unavoidable impurities, and having a metal structure that includes a phase A containing precipitated metal carbides with an average particle size of 10 to 50 μm and a phase B containing precipitated metallic carbides with an average particle size of 10 μm or less which are distributed in a patchy manner, wherein the average particle size DA of the precipitated metallic carbides in the phase A and the average particle size DB of the precipitated metallic carbides in the phase B satisfy DA>DB (see Japanese Unexamined Patent Application, First Publication No. 2013-057094).

Problems to be Solved by the Invention

The characteristics demanded of these types of conventional heat-resistant components, including the sintered alloy disclosed in Japanese Unexamined Patent Application, First Publication No. 2013-057094, include oxidation resistance, wear resistance (including self-wear and low damage to mating materials) and salt damage resistance, and high-Cr steel wrought materials or sintered materials that are able to satisfy these demands are typically used.

For example, an alloy having a composition of Fe-34Cr-2Mo-2Si-1.2C is a known ferrite-based high-Cr steel wrought material, and a sintered alloy having a composition of Fe-34Cr-2Mo-2Si-2C or a sintered alloy having a composition of Fe-30Cr-10Ni-1Mo-1Si-2.5C are typically used as ferrite-based high-Cr steel sintered materials.

Whereas typical stainless steels contain at most about 25% of chromium, alloys having the types of compositions mentioned above have an even higher Cr content in order to improve the oxidation resistance. Further, these alloys all employ a structure in which Cr carbides are precipitated as hard particles within the metal matrix in order to improve the wear resistance.

In alloys having these types of precipitated Cr carbides, a problem arises in that the Cr content of the matrix tends to decrease as a result of the Cr carbide formation. The Cr content of the matrix can be adjusted by controlling the Cr content of the total overall alloy, and by controlling the amount of Cr carbide hard particle precipitation by adjusting the C content.

However, if the precipitation of high-Cr carbide particles is prioritized, then the Cr content of the matrix decreases, causing problems in terms of the oxidation resistance and the salt damage resistance, whereas if the number of high-Cr carbide particles is reduced, then the wear resistance tends to deteriorate.

In addition, in sintered materials, if the Cr content of the overall alloy is increased, then the compressibility of the powder tends to worsen, making it difficult to mold the powder into a desired shape.

Furthermore, in a structure in which high-Cr carbide particles are precipitated in the matrix, although increasing the amount of high-Cr carbide particles yields favorable wear resistance for the sintered material itself, a problem arises in that the wear of sliding mating materials tends to increase.

Against the above background, the inventors of the present invention conducted intensive research into the oxidation resistance and high-temperature wear resistance in sintered materials, and discovered that by employing a high-CrFe alloy rather than using high-Cr carbide particles as the hard particles, a heat-resistant sintered material having excellent oxidation resistance and high-temperature wear resistance, as well as reduced wear of mating materials and superior salt damage resistance could be provided, and they were thus able to complete the present invention.

The present invention has been developed in light of the above circumstances, and has an object of providing a heat-resistant sintered material having excellent oxidation resistance and high-temperature wear resistance, together with reduced wear of mating materials and superior salt damage resistance, as well as providing a method for producing the sintered material.

SUMMARY OF THE INVENTION

Means for Solving the Problems (1) In order to achieve the above object, a heat-resistant sintered material of the present invention has a composition containing, in mass % values, Cr: 25 to 50%, Ni: 2 to 25% and P: 0.2 to 1.2%, with the remainder being Fe and unavoidable impurities, and has a structure including an Fe—Cr matrix, and a hard phase composed of Cr—Fe alloy particles dispersed within the Fe—Cr matrix, wherein the Cr content of the Fe—Cr matrix is from 24 to 41 mass %, the Cr content of the hard phase is from 30 to 61 mass %, and the effective porosity is 2% or less.

Because the heat-resistant sintered material contains Cr, Ni and P in good balance within the Fe, and also contains a desirable amount of a hard phase composed of Cr—Fe alloy particles within the Fe—Cr matrix, a heat-resistant sintered material having excellent corrosion resistance and heat resistance as well as superior wear resistance can be obtained.

Adding P enables an increase in the density of the heat-resistant sintered material, namely a reduction in the effective porosity, resulting in improved oxidation resistance.

(2) In order to achieve the above object, a heat-resistant sintered material of the present invention has a composition containing, in mass % values, Cr: 25 to 50%, Mo: 0.5 to 3% and P: 0.2 to 1.2%, with the remainder being Fe and unavoidable impurities, and has a structure including an Fe—Cr matrix, and a hard phase composed of Cr—Fe alloy particles dispersed within the Fe—Cr matrix, wherein the Cr content of the Fe—Cr matrix is from 24 to 41 mass %, the Cr content of the hard phase is from 30 to 61 mass %, and the effective porosity is 2% or less.

By adding an appropriate amount of Mo to the heat-resistant sintered material, a heat-resistant sintered material having excellent corrosion resistance and heat resistance as well as superior wear resistance can be obtained even without including Ni.

(3) The heat-resistant sintered material according to (1) or (2) may have a structure containing 13 to 67 vol % of the hard phase dispersed within the matrix.

(4) A method for producing a heat-resistant sintered material of the present invention includes:

a step of obtaining a mixed powder by mixing an Fe—Cr—Ni alloy powder, a Cr—Fe alloy powder and a Ni—P alloy powder so as to obtain an overall composition containing, in mass % values, Cr: 25 to 50%, Ni: 2 to 25% and P: 0.2 to 1.2%, a step of preparing a green compact by compressing the mixed powder, and a step of sintering the green compact at 1100 to 1300° C., the method producing a heat-resistant sintered material having a structure including an Fe—Cr matrix and a hard phase composed of Cr—Fe alloy particles dispersed within the matrix, wherein the Cr content of the Fe—Cr matrix is from 24 to 41 mass %, the Cr content of the hard phase is from 30 to 61 mass %, and the effective porosity is 2% or less.

(5) A method for producing a heat-resistant sintered material of the present invention includes:

a step of obtaining a mixed powder by mixing an Fe—Cr—Mo alloy powder, a Cr—Fe alloy powder and an Fe—P alloy powder so as to obtain an overall composition containing, in mass % values, Cr: 25 to 50%, Mo: 0.5 to 3% and P: 0.2 to 1.2%, a step of preparing a green compact by compressing the mixed powder, and a step of sintering the green compact at 1100 to 1300° C., the method producing a heat-resistant sintered material having a structure including an Fe—Cr matrix and a hard phase composed of Cr—Fe alloy particles dispersed within the matrix, wherein the Cr content of the Fe—Cr matrix is from 24 to 41 mass %, the Cr content of the hard phase is from 30 to 61 mass %, and the effective porosity is 2% or less.

(6) In the method for producing a heat-resistant sintered material according to (4) or (5), the proportion of the hard phase within the matrix may be within a range from 13 to 67 vol %.

(7) The heat-resistant sintered material according to (1) or (2), wherein the difference between the Cr content of the Fe—Cr matrix and the Cr content of the hard phase is at least 5 mass %.

(8) The heat-resistant sintered material according to (1) or (2), wherein the Fe—Cr matrix is a ferrite phase, and the Ni content is from 2 to 8 mass %.

(9) The heat-resistant sintered material according to (1) or (2), wherein the Fe—Cr matrix is an austenite phase, and the Ni content is from 8 to 25 mass %.

(10) The method for producing a heat-resistant sintered material according to (4) or (5), wherein the mixing proportion of the Cr—Fe alloy powder in the mixed powder is within a range from 10 to 58 vol %.

Effects of the Invention

The present invention relates to a heat-resistant sintered material having an FeCrNiP composition or an FeCrMoP composition as the basic structure, and having hard particles of a Cr—Fe alloy phase dispersed within a highly corrosion-resistant Fe—Cr matrix. In this heat-resistant sintered material, by dispersing the Cr—Fe alloy phase, which is softer than the high-Cr carbide particles of conventional materials but harder than the matrix, a heat-resistant sintered material can be provided which in addition to having favorable oxidation resistance and excellent high-temperature wear resistance, also exhibits superior salt damage resistance.

Further, because the Cr—Fe alloy phase is softer than the high-Cr carbide particles of conventional materials, the damage to mating materials can be reduced, and wear of sliding mating materials can be suppressed.

DETAILED DESCRIPTION OF THE INVENTION

Embodiments of the present invention are described below with reference to the drawings.

Figure 1:
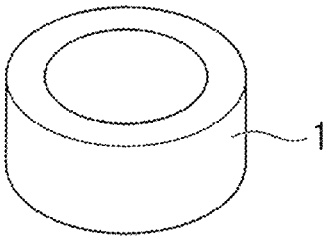
FIG. 1 is a perspective view illustrating one example of a test piece formed from a sintered sliding material according to the present invention.

FIG. 1 illustrates a circular cylindrical bearing member 1 formed from a heat-resistant sintered material according to the present invention, and in one example, this bearing member 1 is used as a bearing incorporated in a nozzle mechanism or a valve mechanism for a turbocharger.

One example of a first heat-resistant sintered material for producing the bearing member 1 is formed from a sintered material having a composition containing, in mass % values, Cr: 25 to 50%, Ni: 2 to 25% and P: 0.2 to 1.2%, with the remainder being Fe and unavoidable impurities, and having a structure including an Fe—Cr matrix and a hard phase composed of Cr—Fe alloy particles dispersed within the Fe—Cr matrix.

Further, a second heat-resistant sintered material for producing the bearing member 1 is formed from a sintered material which, instead of the above composition, has a composition containing, in mass % values, Cr: 25 to 50%, Mo: 0.5 to 3% and P: 0.2 to 1.2%, with the remainder being Fe and unavoidable impurities, and has a structure including an Fe—Cr matrix and a hard phase composed of Cr—Fe alloy particles dispersed within the Fe—Cr matrix.

The method used for producing the above heat-resistant sintered materials is described below in detail, but in one example, the first heat-resistant sintered material can be obtained by weighing an Fe—Cr—Ni alloy powder, a Cr—Fe alloy powder, and either a Ni—P alloy powder or an Fe—P alloy powder so as to obtain an overall composition that satisfies the above range, mixing the powders together uniformly and then press molding the resulting mixed powder, and then sintering the obtained press-molded compact at 1100 to 1300° C.

The second heat-resistant sintered material can be obtained by using an Fe—Cr—Mo alloy powder, a Cr—Fe powder and an Fe—P powder instead of the alloy powders used in obtaining the first heat-resistant sintered material.

In both the first heat-resistant sintered material and the second heat-resistant sintered material, favorable oxidation resistance and salt damage resistance are ensured by the Fe—Cr matrix containing Cr in an Fe base, and the existence of the hard particles formed from the Cr—Fe alloy powder yields excellent wear resistance.

In the present embodiment, the heat-resistant sintered material was used to produce the ring-shaped bearing member 1, but the heat-resistant sintered material of the present embodiment can, of course, be applied to all manner of members, including shaft members, rod members, bearing members and plates provided within the nozzle mechanisms or valve mechanisms of a turbocharger.

A description of the reasons for limiting each of the compositional ratios in the heat-resistant sintered materials (the first heat-resistant sintered material and the second heat-resistant sintered material) of the present embodiment is presented below. For those components that are included in the same amount in the first heat-resistant sintered material and the second heat-resistant sintered material, the description is the same for each of the sintered materials.

In the following description, the total Cr content means "the Cr content (mass %) within the total mass of the heat-resistant sintered material", the total Ni content means "the Ni content (mass %) within the total mass of the heat-resistant sintered material", the total Mo content means "the Mo content (mass %) within the total mass of the heat-resistant sintered material", and the total P content means "the P content (mass %) within the total mass of the heat-resistant sintered material".

[Total Cr Content: 25 to 50 Mass %, Matrix Cr Content: 24 to 41 Mass %, Hard Phase Cr Content: 30 to 61 Mass %]

The total Cr content refers to the Cr contained in both the Fe-based matrix and the Cr—Fe alloy hard phase, and preferably represents at least 25 mass % but not more than 50 mass % of the total mass of the heat-resistant sintered material. If the total Cr content falls below 25 mass %, then the salt damage resistance deteriorates, whereas if the total Cr content exceeds 50 mass %, the effective porosity increases and the oxidation resistance deteriorates. If the total Cr content is less than 20 mass %, then the oxidation resistance deteriorates as well as the salt damage resistance.

In order to meet the demands for improved oxidation resistance, the matrix must contain a minimum of 13 mass % of Cr, but in order to satisfy the requirements for improved salt damage resistance as well as oxidation resistance, the Cr content in the matrix is preferably at least 24 mass %. If the Cr content of the matrix falls below 24 mass %, then the salt damage resistance tends to deteriorate, whereas if the Cr content falls below 13 mass %, then the oxidation resistance also deteriorates together with the salt damage resistance. The Cr content of the matrix is more preferably from 24 to 41 mass %.

The difference between the Cr content of the hard phase and the Cr content of the matrix is preferably at least 5 mass %. It is more preferable that the difference between the Cr content of the hard phase and the Cr content of the matrix is from 10 to 20 mass %.

If the difference between the Cr content of the hard phase and the Cr content of the matrix is less than 5 mass %, then the hard phase function tends to be lost and the wear resistance deteriorates undesirably.

The Cr content of the hard phase is preferably within a range from 30 to 61 mass %. The Cr content of the hard phase is more preferably within a range from 34 to 61 mass %.

[Total Ni Content: 2 to 25 Mass %]

Ni contributes to an improvement in the salt damage resistance. If the total Ni content is less than 2 mass %, then the effect on the salt damage resistance is weak, and because this effect is also poor if the total Ni content exceeds 25 mass %, the total Ni content is preferably not more than 25 mass %. The total Ni content is preferably from 2 to 8 mass % in those cases where the matrix is a ferrite phase, and is preferably from 8 to 25 mass % when the matrix is an austenite phase.

[Total Mo Content: 0.5 to 3 Mass %]

By adding Mo, the salt damage resistance can be improved even without adding Ni.

Including at least 0.5 mass % of Mo contributes to an improvement in the salt damage resistance, and that improvement effect remains effective even if 3 mass % or more is added, but the effect becomes saturated. Because Mo is an expensive element, a smaller Mo content is preferable in terms of cost, and therefore the upper limit for the Mo content is preferably 3 mass %. The total Mo content is more preferably from 1.0 to 3.0 mass %.

[Total P Content: 0.2 to 1.2 Mass %]

P is an element that is desirable in terms of forming a liquid phase during sintering, improving the sinterability of FeCrNi-based sintering materials, reducing the effective porosity of the sintered material, and increasing the sintered material density. By including P, the sinterability improves, and the oxidation resistance improves.

If the P content is less than 0.2 mass %, then increasing the density becomes difficult, achieving an effective porosity of 2% or less is difficult, and the oxidation resistance tends to worsen. If the P content exceeds 1.2 mass %, then the salt damage resistance deteriorates. The total P content is more preferably from 0.4 to 0.8 mass %.

[Hard Phase]

In the heat-resistant sintered material of the present embodiment, the hard phase composed of Cr—Fe alloy particles is preferably dispersed in an amount of 13 to 67 vol %.

Provided the hard phase represents at least 13 vol %, the wear resistance is favorable. On the other hand, if the hard phase exceeds 67 vol %, then production becomes difficult.

In the heat-resistant sintered material, the hard phase is more preferably dispersed in an amount of 15 to 40 vol %.

The heat-resistant sintered material of the present embodiment includes at least 13 vol % of the hard phase, with the remainder being the Fe—Cr matrix and unavoidable impurities (including a third phase, other than the hard phase and the matrix phase, that has no effect on the effects of the present invention).

[Method for Producing Heat-Resistant Sintered Material]

One example of the method for producing the first heat-resistant sintered material is described below.

In one example of the production of a bearing member formed from the heat-resistant sintered material of the present embodiment, a mixing device is used to uniformly mix 22 to 89 mass % of an Fe-25 mass % Cr-20 mass % Ni alloy powder with 10 to 58 mass % of a Cr-40 mass % Fe alloy powder, and 1 to 20 mass % of either a Ni—P alloy powder or an Fe—P alloy powder, thus obtaining a mixed powder having the targeted compositional ratio.

In the following description, reference to the alloy powders such as the Fe-25 mass % Cr-20 mass % Ni powder may exclude the "mass %" units, and be abbreviated as an Fe-25Cr-20Ni alloy powder or similar. Further, the first component (the Fe in the case of the Fe-25Cr-20Ni alloy powder) represents the remainder of the alloy, and therefore the amount is omitted. Each alloy powder may also contain unavoidable impurities.

The Fe—Cr—Ni alloy powder used may, in one example, be an alloy powder containing 24 to 26 mass % of Cr and 18 to 22 mass % of Ni. In the mixed powder, the amount of the Fe—Cr—Ni alloy powder is more preferably within a range from 70 to 85 mass %.

Further, the Cr—Fe alloy powder may, in one example, use an alloy powder containing 50 to 70 mass % of Cr. In the mixed powder, the amount of the Cr—Fe alloy powder is more preferably from 13 to 28 mass %.

Furthermore, the Ni—P alloy powder may, in one example, use an alloy powder containing 10 to 15 mass % of P. In the mixed powder, the amount of the Ni—P alloy powder is more preferably from 1 to 10 mass %.

The Fe—P alloy powder may, in one example, use an alloy powder containing 10 to 30 mass % of P. In the mixed powder, the amount of the Fe—P alloy powder is more preferably from 1 to 5 mass %.

Subsequently, the above mixed powder is placed in the mold of a press apparatus, and press-molded to obtain a green compact of the target shape, for example a cylindrical shape.

For the molding, besides molding with a press apparatus, various other methods may also be used, including hot isostatic pressing (HIP) and cold isostatic pressing (CIP).

By sintering this green compact, for example at a prescribed temperature within a range from 1100 to 1300° C. for a period of about 0.5 to 2 hours, a member such as the cylindrical bearing member 1 illustrated in FIG. 1 can be obtained, formed from a heat-resistant sintered material having a hard phase of a high-Cr—Fe alloy dispersed within an Fe—Cr matrix.

Figure 2:
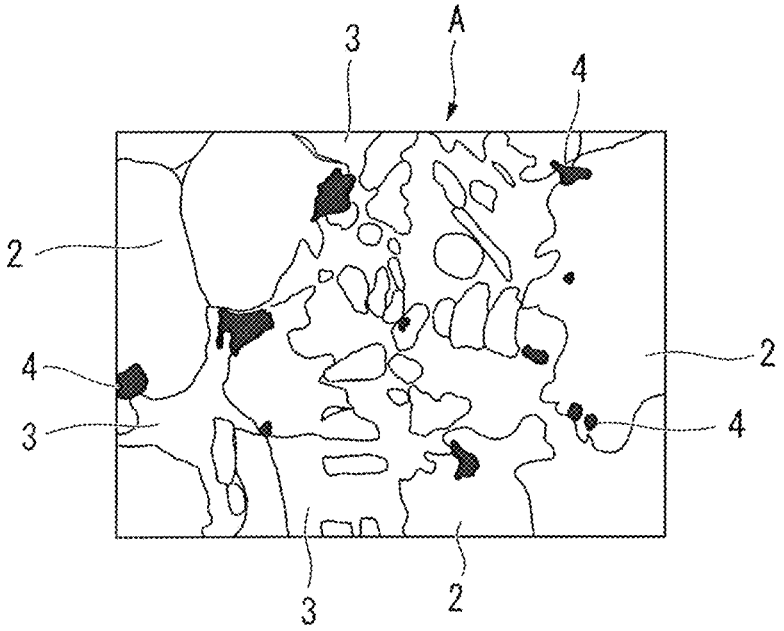
FIG. 2 is a schematic view illustrating one example of the metal structure of the test piece illustrated in FIG. 1.
Figure 3:
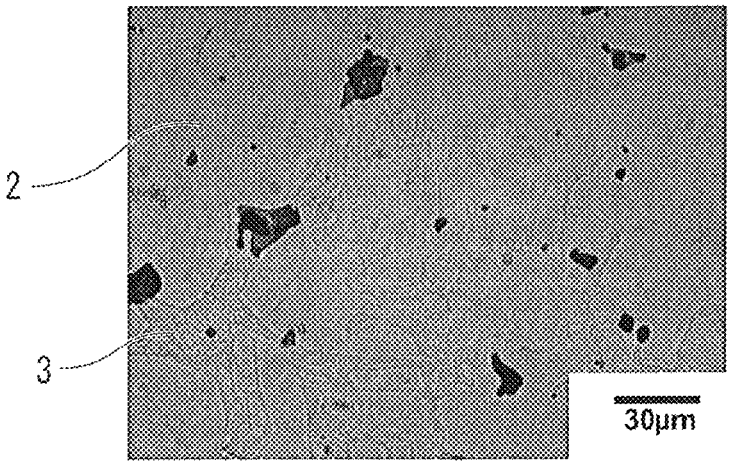
FIG. 3 is a structural photograph, obtained using an optical microscope, illustrating one example of the metal structure of the test piece illustrated in FIG. 1.

As illustrated in FIG. 2 and FIG. 3, the heat-resistant sintered material that constitutes this bearing member 1 has a metal structure A in which a hard Cr—Fe alloy phase 3 is dispersed within an Fe—Cr matrix 2. The metal structure of the bearing member 1 may also contain residual pores 4 that are generated during sintering.

In those cases where the aforementioned Fe—Cr—Ni alloy powder, the Cr—Fe alloy powder and the Ni—P alloy powder are mixed, compressed, and then sintered, because the Ni—P alloy powder has a lower melting point than the other powders, the Ni—P alloy powder becomes a liquid phase that can spread into the grain boundaries between the other powder particles, thereby providing a pore-filling effect. Accordingly, because the grain boundaries between the Fe—Cr—Ni alloy powder and the Cr—Fe alloy powder can be filled by the liquid phase Ni—P alloy, the effective porosity following sintering can be reduced. As a result, a high-density sintered material can be obtained.

In the heat-resistant sintered material obtained using the production method described above, because both the matrix and the hard phase contain at least 25 mass % of Cr, the sintered material exhibits favorable oxidation resistance and salt damage resistance. Further, because the hard phase is composed of a Cr—Fe phase that is harder than the matrix, favorable wear resistance can be achieved in addition to the favorable oxidation resistance and salt damage resistance. Furthermore, because the Cr—Fe phase is softer than the high-Cr carbide particles used in conventional materials, wear of sliding mating materials can be better suppressed than in conventional materials.

Accordingly, even in those cases where the bearing member 1 described above is used in a bearing portion for a turbocharger or the like, and is subjected to sliding contact with a shaft while being exposed to a high-temperature exhaust gas, the bearing member 1 exhibits excellent oxidation resistance, excellent salt damage resistance, and excellent wear resistance. Further, because wear of the shaft that represents the mating member can be suppressed, a suppression effect on wear of the shaft can also be obtained.

The heat-resistant sintered material of the present embodiment can, of course, also be used as a structural material for the turbocharger shaft, and as a structural material for components of various mechanisms that require oxidation resistance, salt damage resistance and wear resistance when provided in an environment exposed to a high-temperature corrosive gas.

One example of the method for producing the second heat-resistant sintered material is described below.

The heat-resistant sintered material of the present invention can be obtained using a composition containing added Mo instead of Ni.

In this case, in one example, a mixing device is used to uniformly mix 37 to 89 mass % of an Fe-25Cr-2Mo alloy powder with 10 to 58 mass % of a Cr-40Fe alloy powder, and 1 to 5 mass % of an Fe—P alloy powder, thus obtaining a mixed powder having the targeted compositional ratio. Using the same method as that described above for the method for producing the first heat-resistant sintered material, this mixed powder is then used to form a green compact, which is then sintered to obtain a heat-resistant sintered material.

The Fe—Cr—Mo alloy powder may, in one example, use an alloy powder containing 24 to 26 mass % of Cr and 1 to 3 mass % of Mo.

The Cr—Fe alloy powder may, in one example, use an alloy powder containing 50 to 70 mass % of Cr.

The Fe—P alloy powder may, in one example, use an alloy powder containing 15 to 35 mass % of P.

EXAMPLES

The present invention is described below in further detail using a series of examples, but the present invention is in no way limited by these examples.

Example 1

An Fe-25Cr-20Ni alloy powder, a Cr-40Fe alloy powder and a Ni-12P alloy powder were prepared as raw material powders, these raw material alloy powders were blended to obtain the final component compositions shown in Tables 1 to 3, and each composition was then mixed for 30 minutes using a V-type mixer, and then press-molded at a molding pressure of 588 MPa to produce a cylindrical green compact.

Next, each green compact was sintered in a vacuum atmosphere at a temperature of 1250 to 1280° C. for 1.5 hours to obtain a heat-resistant sliding material (sample No. 1 to 29).

Further, an Fe-25Cr-2Mo alloy powder, a Cr-40Fe alloy powder and a Fe-27P alloy powder were prepared as raw material powders, these raw material alloy powders were blended to obtain the final component compositions shown in Table 4, and a series of heat-resistant sliding materials (sample No. 30 to 35) was obtained using the same method as that used for the samples of No. 1 to 29.

Each of the sintered sliding materials was molded into a series of shapes suitable for each of the following tests, and each test was then performed.

[Cr Content of Matrix]

The Cr content of the matrix (proportion of Cr in the matrix) in each of the obtained heat-resistant sliding members 1 to 35 was obtained by measurement using SEM-EDX.

[Cr Content of Hard Phase]

The Cr content of the hard phase (proportion of Cr in the hard phase) in each of the obtained heat-resistant sliding members 1 to 35 was obtained by measurement using SEM-EDX.

[Hard Phase Volume Fraction]

In each of the obtained heat-resistant sliding members 1 to 35, the hard phase volume fraction was measured by linear analysis. A photograph of the material structure was obtained for each sample, twenty lines were drawn randomly on the photograph at fixed intervals, and the sum of the line length portions that passed through hard phase portions was determined. This sum (L2) of the line length portions that passed through hard phase portions was divided by the length (L1) of a single line drawn from edge to edge of the structure photograph, and the value obtained by expressing the result as a percentage was deemed the hard phase volume fraction. In other words, the hard phase volume fraction was calculated as (L2/L1)×00(%).

[Density, Effective Porosity]

Each value was measured by the Archimedes method.

[Oxidation Resistance Test]

In the oxidation resistance test, ring-shaped heat-resistant sintered materials (bearing members) having dimensions of outer diameter: 20 mm×inner diameter: 10 mm×height: 5 mm, composed of each of the FeCrNiMoP-based sintered materials with the composition components shown below in Tables 1 to 4, were prepared and tested.

Each ring-shaped heat-resistant sintered material test piece was heated in the open atmosphere at 800° C. for 100 hours, the change in weight was measured, and the value calculated by dividing this weight change by the surface area of the sample (weight change per unit of surface area) was calculated as the weight increase due to oxidation.

In the oxidation resistance test, ring-shaped heat-resistant sintered materials for which the weight increase due to oxidation (weight change per unit of surface area) was 7.0 $mg/cm^2$ or less were evaluated as "A", and ring-shaped heat-resistant sintered materials for which the weight increase due to oxidation exceeded 7.0 $mg/cm^2$ were evaluated as B.

[Wear Resistance Test]

A "roll on block" test was performed by placing a circular cylindrical shaft on a block (wear test piece), and rotating the shaft back and forth through 90°. The test was performed for 30 minutes at a measurement temperature of 600° C., with 2,000 back and forth rotations performed, and the amount of wear was evaluated.

Measurement of the amount of wear was performed by acquiring a photograph of the wear surface using a 3D microscope, and measuring the wear depth. The wear test piece was a rectangular prism-shaped block formed from the sintered material and had dimensions of 50×10 mm and a thickness of 5 mm. The mating material shaft was a stainless steel rod formed from SUS316 with a diameter of 8 mm and a length of 150 mm. The test was performed by pressing the stainless steel rod against the block with a load of 80 N, and rotating the rod back and forth as the rotational shaft of a motor.

In the wear resistance test, wear test pieces for which the amount of wear was 4.0 μm or less were evaluated as "A", and wear test pieces for which the amount of wear exceeded 4.0 μm were evaluated as "B".

[Salt Damage Resistance Test]

The salt damage resistance was ascertained using a salt water spray test (prescribed in JIS Z2371). The surface area fraction of external rust generated by a salt water spray of a 5% aqueous solution of NaCl (35° C., 24 hours) was evaluated, and samples for which the corroded surface area fraction due to rust generation was 1% or less were deemed to have passed. The test piece was a ring-shaped test piece having an outer diameter of 20 mm, and inner diameter of 10 mm, and a height of 5 mm. Evaluations of "A" correspond with test pieces having a corroded surface area fraction due to rust of 1% or less, whereas evaluations of "B" correspond with test pieces having a corroded surface area fraction due to rust exceeding 1%.

The results of the above tests are shown below in Tables 1 to 4.

TABLE 1

| Sample No. | Hard particles Amount added (mass %) | Total composition (mass %) Fe | Cr | Ni | Mo | P | Matrix Cr content (mass %) | Hard phase Cr content (mass %) |
|---|---|---|---|---|---|---|---|---|
| 1 | 0 | 55.0 | 25.0 | 20.0 | 0.0 | 0.0 | 25.0 | 0.0 |
| 2 | 0 | 52.1 | 23.8 | 23.5 | 0.0 | 0.6 | 23.8 | 0.0 |
| 3 | 5 | 51.4 | 25.5 | 22.5 | 0.0 | 0.6 | 23.9 | 38.0 |
| 4 | 10 | 50.7 | 27.1 | 21.6 | 0.0 | 0.6 | 24.5 | 39.0 |
| 5 | 18 | 49.6 | 29.8 | 20.0 | 0.0 | 0.6 | 25.9 | 40.0 |
| 6 | 25 | 48.6 | 32.1 | 18.7 | 0.0 | 0.6 | 25.8 | 41.0 |
| 7 | 30 | 47.9 | 33.8 | 17.8 | 0.0 | 0.6 | 26.2 | 42.0 |
| 8 | 40 | 46.4 | 37.1 | 15.9 | 0.0 | 0.6 | 28.6 | 43.0 |
| 9 | 50 | 45.0 | 40.5 | 13.9 | 0.0 | 0.6 | 29.7 | 44.0 |
| 10 | 58 | 43.9 | 43.1 | 12.4 | 0.0 | 0.6 | 29.9 | 45.4 |
| 11 | 60 | Production impossible | | | | | | |
| 12 | 50 | 36.0 | 49.5 | 13.9 | 0.0 | 0.6 | 40.7 | 61.0 |
| 13 | 50 | 34.5 | 51.0 | 13.9 | 0.0 | 0.6 | 44.0 | 63.0 |
| 14 | 25 | 53.3 | 27.4 | 18.7 | 0.0 | 0.6 | 25.9 | 30.9 |
| 15 | 25 | 55.7 | 25.0 | 18.7 | 0.0 | 0.6 | 24.5 | 28.0 |

| Sample No. | Hard phase volume fraction (vol %) | Oxidation resistance: Weight increase due to oxidation ($mg/cm^2$) 800° C. | Effective porosity | Grade | Salt damage resistance: Corroded surface area fraction (1% or less) | Wear resistance: Amount of wear (μm) | Grade | |
|---|---|---|---|---|---|---|---|---|
| 1 | 0.0 | 21.2 | 5.3% | B | A | 12 | B | Comparative example |
| 2 | 0.0 | 0.8 | 0.2% | A | B | 10 | B | Comparative example |
| 3 | 7.4 | 1.2 | 0.3% | A | B | 5 | B | Comparative example |
| 4 | 13.0 | 1.7 | 0.4% | A | A | 2 | A | Example |
| 5 | 21.5 | 2.4 | 0.6% | A | A | 1.2 | A | Example |
| 6 | 31.3 | 2.1 | 0.7% | A | A | 1 | A | Example |
| 7 | 36.8 | 2.6 | 0.8% | A | A | 0.9 | A | Example |
| 8 | 46.5 | 2.8 | 1.0% | A | A | 1 | A | Example |
| 9 | 58.3 | 4.8 | 1.2% | A | A | 0.7 | A | Example |
| 10 | 67.4 | 5.6 | 1.7% | A | A | 0.8 | A | Example |
| 11 | | | | | | | | Comparative example |
| 12 | 47.9 | 5.8 | 1.9% | A | A | 1.1 | A | Example |
| 13 | 46.0 | 8.0 | 2.3% | B | A | 1.1 | A | Comparative example |
| 14 | 25.8 | 2.3 | 0.6% | A | A | 2 | A | Example |
| 15 | 23.7 | 2.3 | 0.6% | A | A | 7 | B | Comparative example |

TABLE 2

| Sample No. | Hard particles Amount added (mass %) | Total composition (mass %) Fe | Cr | Ni | Mo | P | Matrix Cr content (mass %) | Hard phase Cr content (mass %) |
|---|---|---|---|---|---|---|---|---|
| 16 | 18 | 50.5 | 29.7 | 19.9 | 0.0 | 0.00 | 26.9 | 40.0 |
| 17 | 18 | 50.4 | 29.7 | 19.9 | 0.0 | 0.10 | 26.9 | 40.0 |
| 18 | 18 | 50.3 | 29.7 | 19.9 | 0.0 | 0.15 | 26.9 | 40.0 |
| 19 | 18 | 50.3 | 29.7 | 19.9 | 0.0 | 0.20 | 26.9 | 40.0 |
| 20 | 18 | 49.9 | 29.7 | 19.9 | 0.0 | 0.60 | 26.9 | 40.0 |
| 21 | 18 | 49.5 | 29.7 | 19.9 | 0.0 | 1.00 | 26.9 | 40.0 |
| 22 | 18 | 49.3 | 29.7 | 19.9 | 0.0 | 1.20 | 26.9 | 40.0 |
| 23 | 18 | 49.1 | 29.7 | 19.9 | 0.0 | 1.40 | 26.9 | 40.0 |

TABLE 2-continued

| Sample No. | Hard phase volume fraction (vol %) | Oxidation resistance: Weight increase due to oxidation ($mg/cm^2$) 800° C. | Oxidation resistance: Effective porosity | Oxidation resistance: Grade | Salt damage resistance Corroded surface area fraction (1% or less) | Wear resistance: Amount of wear (μm) | Wear resistance: Grade | |
|---|---|---|---|---|---|---|---|---|
| 16 | 19.2 | 21.2 | 5.3% | B | A | 1.2 | A | Comparative example |
| 17 | 19.2 | 10.9 | 2.7% | B | A | 1.2 | A | Comparative example |
| 18 | 19.2 | 8.0 | 2.0% | B | A | 1.2 | A | Comparative example |
| 19 | 19.2 | 3.0 | 0.6% | A | A | 1.2 | A | Example |
| 20 | 19.2 | 2.4 | 0.6% | A | A | 1.2 | A | Example |
| 21 | 19.2 | 2.4 | 0.6% | A | A | 1.2 | A | Example |
| 22 | 19.2 | 2.4 | 0.6% | A | A | 1.2 | A | Example |
| 23 | 19.2 | 2.4 | 0.6% | A | B | 1.2 | A | Comparative example |

TABLE 3

| Sample No. | Hard particles Amount added (mass %) | Total composition (mass %): Fe | Cr | Ni | Mo | P | Matrix Cr content (mass %) | Hard phase Cr content (mass %) |
|---|---|---|---|---|---|---|---|---|
| 24 | 18 | 69.7 | 29.7 | 0.0 | 0.0 | 0.6 | 26.9 | 40.0 |
| 25 | 18 | 68.7 | 29.7 | 1.0 | 0.0 | 0.6 | 26.9 | 40.0 |
| 26 | 18 | 67.7 | 29.7 | 2.0 | 0.0 | 0.6 | 26.9 | 40.0 |
| 27 | 18 | 59.7 | 29.7 | 10.0 | 0.0 | 0.6 | 26.9 | 40.0 |
| 28 | 18 | 49.9 | 29.7 | 19.0 | 0.0 | 0.6 | 26.9 | 40.0 |
| 29 | 18 | 44.7 | 29.7 | 25.0 | 0.0 | 0.6 | 26.9 | 40.0 |

| Sample No. | Hard phase volume fraction (vol %) | Oxidation resistance: Weight increase due to oxidation ($mg/cm^2$) 800° C. | Oxidation resistance: Effective porosity | Oxidation resistance: Grade | Salt damage resistance Corroded surface area fraction (1% or less) | Wear resistance: Amount of wear (μm) | Wear resistance: Grade | |
|---|---|---|---|---|---|---|---|---|
| 24 | 19.1 | 0.8 | 0.2% | A | B | 2 | A | Comparative example |
| 25 | 19.1 | 1.2 | 0.3% | A | B | 3 | A | Comparative example |
| 26 | 19.1 | 1.7 | 0.4% | A | A | 2 | A | Example |
| 27 | 19.1 | 2.4 | 0.4% | A | A | 1 | A | Example |
| 28 | 19.1 | 2.2 | 0.4% | A | A | 2 | A | Example |
| 29 | 19.1 | 2.0 | 0.3% | A | A | 3 | A | Example |

TABLE 4

| Sample No. | Hard particles Amount added (mass %) | Total composition (mass %): Fe | Cr | Ni | Mo | P | Matrix Cr content (mass %) | Hard phase Cr content (mass %) |
|---|---|---|---|---|---|---|---|---|
| 30 | 18 | 69.7 | 29.7 | 0.0 | 0.0 | 0.6 | 26.9 | 40.0 |
| 31 | 18 | 69.3 | 29.7 | 0.0 | 0.4 | 0.6 | 26.9 | 40.0 |
| 32 | 18 | 69.2 | 29.7 | 0.0 | 0.5 | 0.6 | 26.9 | 40.0 |
| 33 | 18 | 68.7 | 29.7 | 0.0 | 1.0 | 0.6 | 26.9 | 40.0 |
| 34 | 18 | 67.7 | 29.7 | 0.0 | 2.0 | 0.6 | 26.9 | 40.0 |
| 35 | 18 | 66.7 | 29.7 | 0.0 | 3.0 | 0.6 | 26.9 | 40.0 |

TABLE 4-continued

| Sample No. | Hard phase volume fraction (vol %) | Oxidation resistance: Weight increase due to oxidation ($mg/cm^2$) 800° C. | Oxidation resistance: Effective porosity | Oxidation resistance: Grade | Salt damage resistance: Corroded surface area fraction (1% or less) | Wear resistance: Amount of wear (μm) | Wear resistance: Grade | |
|---|---|---|---|---|---|---|---|---|
| 30 | 19.1 | 0.8 | 0.2% | A | B | 2 | A | Comparative example |
| 31 | 19.2 | 0.8 | 0.2% | A | B | 2 | A | Comparative example |
| 32 | 19.2 | 0.8 | 0.2% | A | A | 2 | A | Example |
| 33 | 19.2 | 0.8 | 0.2% | A | A | 2 | A | Example |
| 34 | 19.2 | 1.2 | 0.3% | A | A | 2 | A | Example |
| 35 | 19.2 | 2.5 | 0.6% | A | A | 2 | A | Example |

Table 1 indicates the relationship between the overall total composition and the Cr content of the matrix used for heat-resistant sintered material samples having varying amounts added (mass %) of the Cr-40Fe alloy powder composed of hard particles, and also shows the oxidation resistance test result, the measurement result and the evaluation grade for the effective porosity, the result of an external appearance inspection for salt damage resistance, and the measurement result and the evaluation grade for the wear resistance for each of the samples from No. 1 to 15.

Based on the results in Table 1 it is clear that in the sample No. 1, in which the amount added of the Cr-40Fe alloy powder composed of hard particles was 0%, and the total composition was a composition composed of only the matrix, the effective porosity was high and the amount of wear also increased. In the sample No. 2, in which the amount added of the Cr-40Fe alloy powder composed of hard particles was 0%, but P was added, although the oxidation resistance improved markedly, rust occurred, and the amount of wear also increased.

In the sample No. 3, in which 5 mass % of the Cr-40Fe alloy powder composed of hard particles was added, although the wear resistance improved relative to the sample No. 2, rust still occurred. It is thought that this is because the Cr content of the matrix was less than 24 mass %. In the sample No. 4, in which 10 mass % of the Cr-40Fe alloy powder composed of hard particles was added, the effective porosity was low, the surface area fraction of rust occurrence was small, and the amount of wear was able to be reduced, while maintaining excellent oxidation resistance.

Accordingly, based on the results of Table 1, it was evident that a sample obtained by adding at least 10 mass % of a Cr—Fe alloy powder composed of hard particles, and containing at least 26 mass % of Cr and 0.6 mass % of P exhibited excellent results for all three properties of oxidation resistance, salt damage resistance and wear resistance. Further, a sample containing 60 mass % of the hard Cr—Fe alloy powder exhibited poor powder compressibility, and shape formation proved impossible.

Table 3 (Ni content) shows the results of producing a series of samples in which the amount added of the Cr-40Fe alloy powder composed of hard particles was fixed at 18 mass %, and the Ni content of the total composition was altered by varying the amount added of Ni powder, and the results of then subjecting each sample to the oxidation resistance test, measurement of the effective porosity, the salt damage resistance test, and the wear resistance test.

Based on the results in Table 3, it is evident that at a Ni content of less than 2.0 mass % of the total composition, the corroded surface area fraction exceeded 1% in the salt damage resistance test. Accordingly, it was clear that the Ni content of the total composition needed to be at least 2.0 mass %. Further, no problems arose even when the Ni content of the total composition was increased to about 20 mass %.

Table 2 (P content) shows the results of producing a series of samples in which the amount added of the Cr-40Fe alloy powder composed of hard particles was fixed at 18 mass %, and the P content of the total composition was altered by varying the amount added of the NiP alloy powder, and the results of then subjecting each sample to the oxidation resistance test, measurement of the effective porosity, the salt damage resistance test, and the wear resistance test.

Based on Table 2 (P content), it is evident that at a P content of less than 0.2 mass % of the total composition, the oxidation resistance was inferior and the effective porosity was high. Further, sample No. 23 that had a P content of 1.4 mass % displayed a corroded surface area fraction exceeding 1% in the salt damage resistance test.

Accordingly, in order to satisfy the required levels of oxidation resistance, salt damage resistance and wear resistance, it was clear that the P content of the total composition needed to be within a range from 0.2 to 1.2 mass %.

Table 4 shows the results of producing a series of samples in which the amount added of the Cr-40Fe alloy powder composed of hard particles was fixed at 18 mass %, and the Mo content of the total composition was altered by adjusting the Mo content of the Fe—Cr—Mo alloy particles, and the results of then subjecting each sample to the oxidation resistance test, measurement of the effective porosity, the salt damage resistance test, and the wear resistance test.

Based on Table 4, it is evident that at a Mo content of not more than 0.4 mass % (less than 0.5 mass %) of the total composition, no salt damage resistance improvement effect was obtained, whereas even if the Mo content was increased beyond 3 mass %, no further improvement in that effect was obtained.

Figure 4:
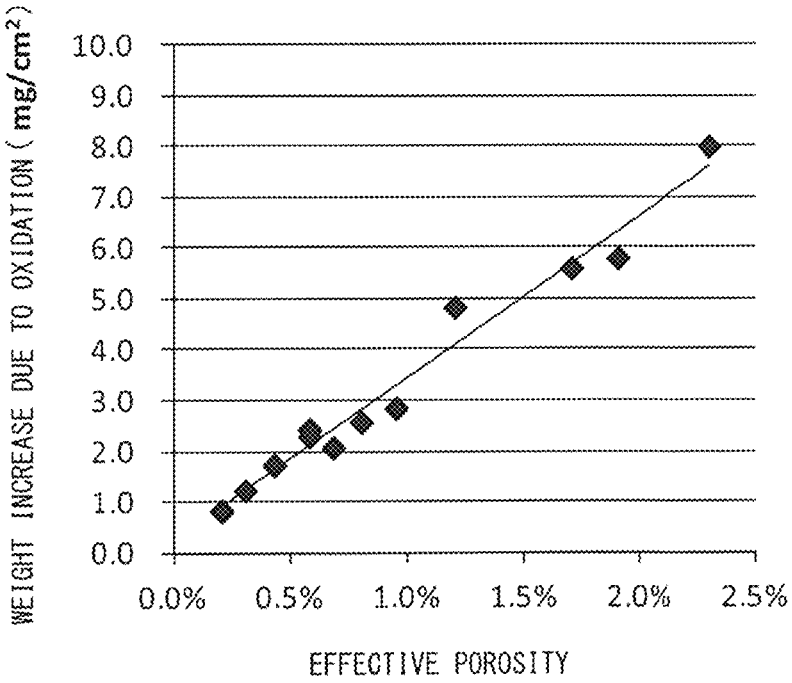
FIG. 4 is a graph illustrating the relationship between the weight increase due to oxidation and the effective porosity obtained from test results in the examples.

FIG. 4 is a graph illustrating the relationship between the effective porosity and the weight increase due to oxidation for the samples of Table 1.

Based on FIG. 4, it is clear that as the effective porosity increases, the weight increase due to oxidation increases, indicating a more easily oxidized material. Accordingly, it is evident that reducing the effective porosity is advantageous in improving the oxidation resistance.

Figure 5:
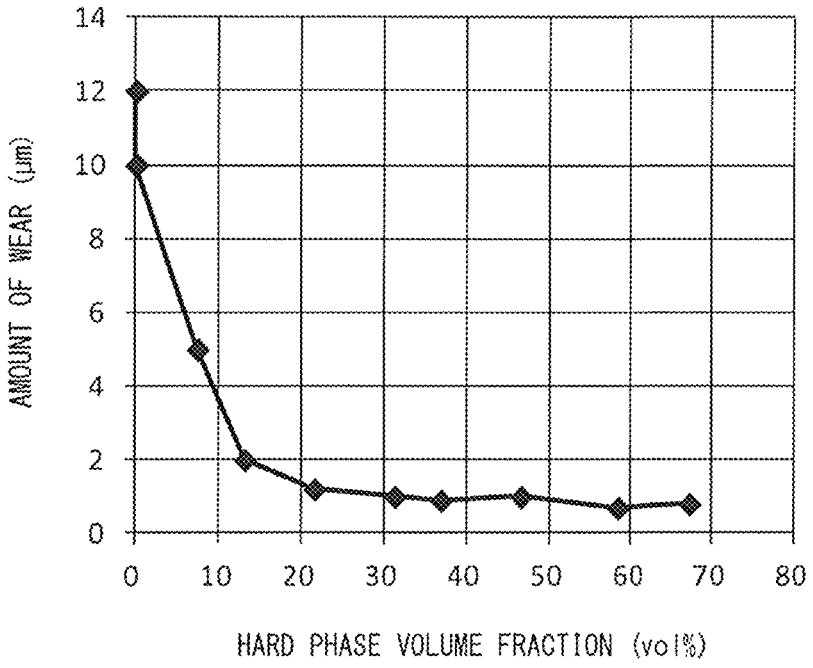
FIG. 5 is a graph illustrating the relationship between the amount of wear and the hard phase fraction obtained from test results in the examples.

FIG. 5 is a graph illustrating the relationship between the hard phase volume fraction and the amount of wear for the samples of No. 1 to 10 listed in Table 1.

As illustrated in FIG. 5, when the hard phase fraction (vol %) in the sintered material is 0% or 7.4%, the amount of wear is large, but provided the hard phase fraction is at least 13 vol %, the amount of wear is able to be satisfactorily reduced to a low value.

Accordingly, it is evident that the proportion of the hard phase of the heat-resistant sintered material is preferably within a range from 13 to 67 vol %.

INDUSTRIAL APPLICABILITY

The heat-resistant sintered material of the present invention exhibits excellent oxidation resistance, high-temperature wear resistance and salt damage resistance, and can therefore be used widely, not only for bearings incorporated in nozzle mechanisms or valve mechanisms for turbochargers, but also for shaft members, rod members, bearing members and plates provided within the nozzle mechanisms or valve mechanisms of turbochargers.

DESCRIPTION OF THE REFERENCE SIGNS

1: Bearing member (heat-resistant sintered material)
A: Metal structure
2: Matrix
3: Hard phase
4: Pore

The invention claimed is:

1. A heat-resistant sintered material having excellent oxidation resistance, high-temperature wear resistance and salt damage resistance, the heat-resistant sintered material comprising:
Cr: 25 to 50 mass %;
Ni: 2 to 25 mass %;
P: 0.2 to 1.2 mass %; and
a remainder being Fe and unavoidable impurities, wherein
the heat-resistant sintered material has a structure comprising an Fe—Cr matrix, and a hard phase composed of Cr—Fe alloy particles dispersed within the Fe—Cr matrix,
the structure lacks Cr carbide particles,
a Cr content of the Fe—Cr matrix is from 24 to 41 mass %,
a Cr content of the hard phase is from 30 to 61 mass %, and
an effective porosity is 2% or less.

2. A heat-resistant sintered material having excellent oxidation resistance, high-temperature wear resistance and salt damage resistance, the heat-resistant sintered material comprising:
Cr: 25 to 50 mass %;
Mo: 0.5 to 3 mass %;
P: 0.2 to 1.2 mass %; and
a remainder being Fe and unavoidable impurities, wherein
the heat-resistant sintered material has a structure including an Fe—Cr matrix, and a hard phase composed of Cr—Fe alloy particles dispersed within the Fe—Cr matrix,
the structure lacks Cr carbide particles,
a Cr content of the Fe—Cr matrix is from 24 to 41 mass %,
a Cr content of the hard phase is from 30 to 61 mass %, and
an effective porosity is 2% or less.

3. The heat-resistant sintered material having excellent oxidation resistance, high-temperature wear resistance and salt damage resistance according to claim 1, wherein the structure includes 13 to 67 vol % of the hard phase.

4. A method for producing a heat-resistant sintered material having excellent oxidation resistance, high-temperature wear resistance and salt damage resistance, the method comprising the steps of:
obtaining a mixed powder by mixing an Fe—Cr—Ni alloy powder, a Cr—Fe alloy powder and a Ni—P alloy powder so as to obtain an overall composition comprising, in mass % values, Cr: 25 to 50%, Ni: 2 to 25% and P: 0.2 to 1.2%,
preparing a green compact by compressing the mixed powder, and
sintering the green compact at 1100 to 1300° C., and
yielding a heat-resistant sintered material having a structure including an Fe—Cr matrix and a hard phase composed of Cr—Fe alloy particles dispersed within the Fe—Cr matrix, wherein
the structure lacks Cr carbide particles,
a Cr content of the Fe—Cr matrix is from 24 to 41 mass %,
a Cr content of the hard phase is from 30 to 61 mass %, and
an effective porosity is 2% or less.

5. A method for producing a heat-resistant sintered material having excellent oxidation resistance, high-temperature wear resistance and salt damage resistance, the method comprising the steps of:
obtaining a mixed powder by mixing an Fe—Cr—Mo alloy powder, a Cr—Fe alloy powder and an Fe—P alloy powder so as to obtain an overall composition comprising, in mass % values, Cr: 25 to 50%, Mo: 0.5 to 3% and P: 0.2 to 1.2%,
preparing a green compact by compressing the mixed powder, and
sintering the green compact at 1100 to 1300° C., and
yielding a heat-resistant sintered material having a structure including an Fe—Cr matrix and a hard phase composed of Cr—Fe alloy particles dispersed within the Fe—Cr matrix, wherein
the structure lacks Cr carbide particles,
a Cr content of the Fe—Cr matrix is from 24 to 41 mass %,
a Cr content of the hard phase is from 30 to 61 mass %, and
an effective porosity is 2% or less.

6. The heat-resistant sintered material having excellent oxidation resistance, high-temperature wear resistance and salt damage resistance according to claim 1, wherein a difference between a Cr content of the Fe—Cr matrix and a Cr content of the hard phase is at least 5 mass %.

7. The heat-resistant sintered material having excellent oxidation resistance, high-temperature wear resistance and salt damage resistance according to claim 1, wherein the Fe—Cr matrix is a ferrite phase, and a Ni content is from 2 to 8 mass %.

8. The heat-resistant sintered material having excellent oxidation resistance, high-temperature wear resistance and salt damage resistance according to claim 1, wherein the Fe—Cr matrix is an austenite phase, and a Ni content is from 8 to 25 mass %.

9. The method for producing a heat-resistant sintered material having excellent oxidation resistance, high-temperature wear resistance and salt damage resistance according to claim 4, wherein a mixing proportion of the Cr—Fe alloy powder in the mixed powder is within a range from 10 to 58 vol %.

10. The heat-resistant sintered material having excellent oxidation resistance, high-temperature wear resistance and salt damage resistance according to claim 2, wherein the structure includes 13 to 67 vol % of the hard phase.

11. The heat-resistant sintered material having excellent oxidation resistance, high-temperature wear resistance and salt damage resistance according to claim 2, wherein a difference between a Cr content of the Fe—Cr matrix and a Cr content of the hard phase is at least 5 mass %.

12. The heat-resistant sintered material having excellent oxidation resistance, high-temperature wear resistance and salt damage resistance according to claim 2, wherein the Fe—Cr matrix is a ferrite phase, and a Ni content is from 2 to 8 mass %.

13. The heat-resistant sintered material having excellent oxidation resistance, high-temperature wear resistance and salt damage resistance according to claim 2, wherein the Fe—Cr matrix is an austenite phase, and a Ni content is from 8 to 25 mass %.

14. The method for producing a heat-resistant sintered material having excellent oxidation resistance, high-temperature wear resistance and salt damage resistance according to claim 5, wherein a mixing proportion of the Cr—Fe alloy powder in the mixed powder is within a range from 10 to 58 vol %.

* * * * *